US008253051B2

(12) United States Patent
Dai

(10) Patent No.: US 8,253,051 B2
(45) Date of Patent: Aug. 28, 2012

(54) POWER SWITCH MODULE AND ELECTRONIC DEVICE USING THE SAME

(75) Inventor: Bin Dai, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 405 days.

(21) Appl. No.: 12/644,363

(22) Filed: Dec. 22, 2009

(65) Prior Publication Data

US 2011/0094866 A1 Apr. 28, 2011

(30) Foreign Application Priority Data

Oct. 23, 2009 (CN) ..... 2009 1 0308744

(51) Int. Cl.
*H01H 13/10* (2006.01)

(52) U.S. Cl. ..... 200/345; 200/344

(58) Field of Classification Search ..... 200/345
See application file for complete search history.

(56) References Cited

U.S. PATENT DOCUMENTS 5,912,443 A * 6/1999 Hasunuma ..... 200/5 A
7,015,897 B2 * 3/2006 Tsao ..... 345/168
8,030,585 B2 * 10/2011 Wang ..... 200/344

* cited by examiner

*Primary Examiner* — Renee Luebke
*Assistant Examiner* — Lheiren Mae Caroc
(74) *Attorney, Agent, or Firm* — Altis Law Group, Inc.

(57) ABSTRACT

A power switch module includes a printed circuit board having a switch, a support plate engaging the printed circuit board, a control to activate the switch, and an elastic member fixed to the support plate and positioned between the printed circuit board and the control. The elastic member has a plurality of resisting portions thereon to elastically resist the control. One of the elastic member and the control has a plurality of hook portions, and the other has a plurality of latching portions engaging with the hook portions.

13 Claims, 4 Drawing Sheets

POWER SWITCH MODULE AND ELECTRONIC DEVICE USING THE SAME

CROSS-REFERENCE TO RELATED APPLICATION

This application is related to a co-pending U.S. patent application Ser. No. 12/641,611, file on Dec. 12, 2009, and entitled "POWER BUTTON ASSEMBLY AND ELECTRONIC DEVICE USING THE SAME". The inventor of the co-pending application is Bin Dai. The co-pending application has the same assignee as the present application. The Specification and Drawings of the co-pending application is incorporated herein by reference.

BACKGROUND

1. Technical Field

The present disclosure relates to a power switch module and an electronic device using the power switch module.

2. Description of the Related Art

An electronic device is generally provided with a power switch module to turn a power supply on and off. A commonly used power switch module includes a plurality of components such as a printed circuit board (PCB), a support plate, a control, and an elastic member positioned between the control and the PCB to generate an elastic force to resist the control. The control may be received in an assembly hole defined in a housing of the electronic device. The PCB may engage the support plate. During assembly of the power switch module to the housing of the electronic device, the control is received in the assembly hole, the elastic member is positioned on one side of the control adjacent to the PCB, and the support plate is connected to the housing to bias the elastic member. During assembly, the elastic member and the control require manual positioning which is difficult to accurately position. Over time, the elastic member may loosen and no longer supply a sufficient stable elastic force to resist the control, such that operation of the power switch module becomes frustrated.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Figure 1:
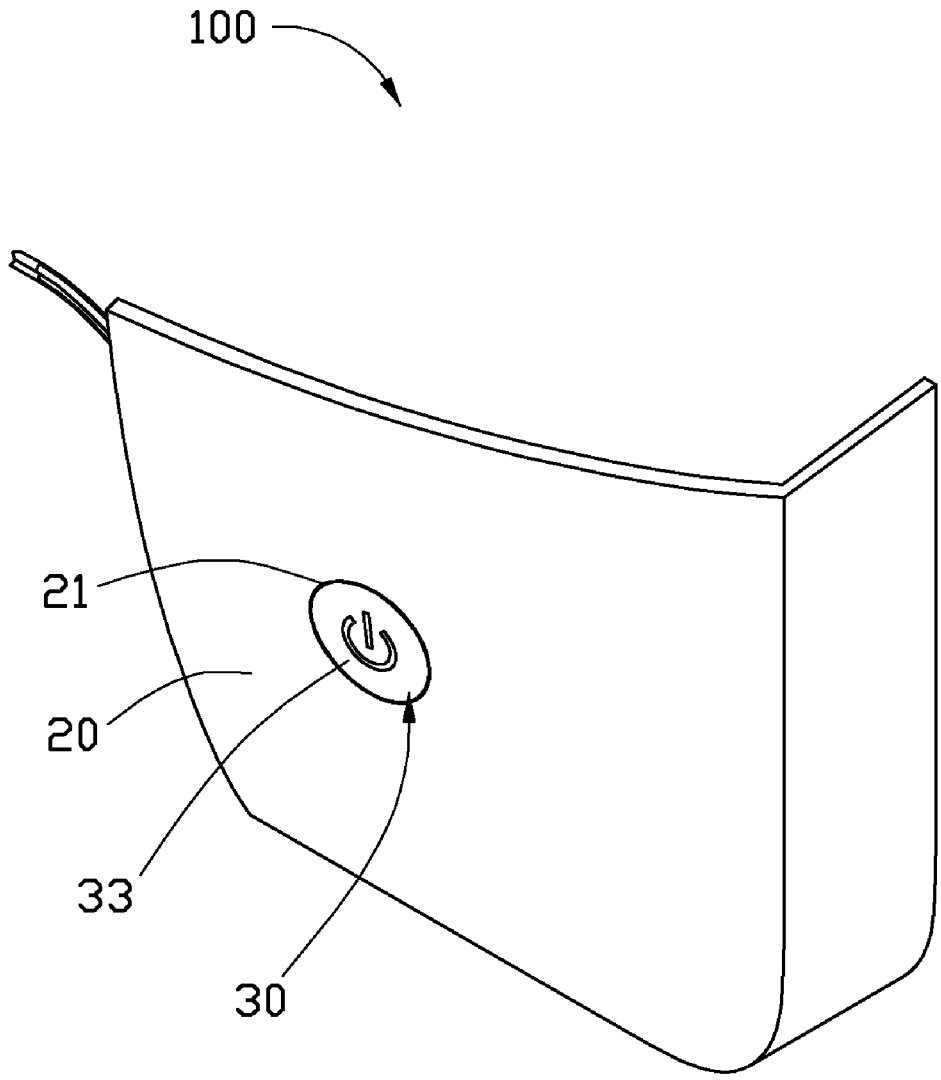
FIG. 1 is a partial, perspective view of an embodiment of an electronic device, the electronic device including an embodiment of a power switch module.
Figure 2:
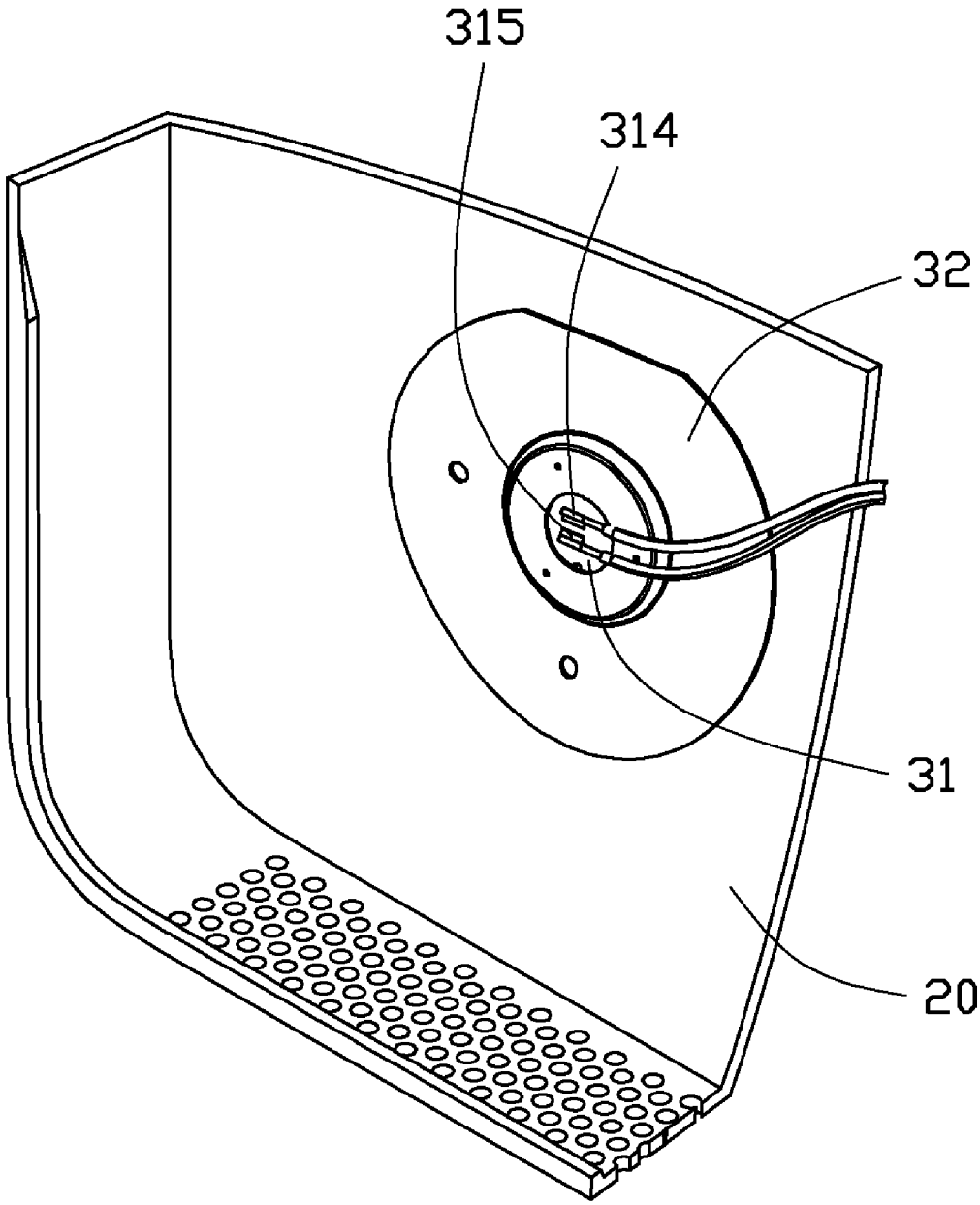
FIG. 2 is similar to FIG. 1, but viewed from another aspect.

Referring to FIGS. 1 and 2, an embodiment of an electronic device 100 includes a housing 20 and a power switch module 30. The housing 20 defines an assembly hole 21 therein. The electronic device 100 may be a notebook, a desktop computer, a liquid crystal display or other electronic device capable of employing the power switch module 30.

Figure 3:
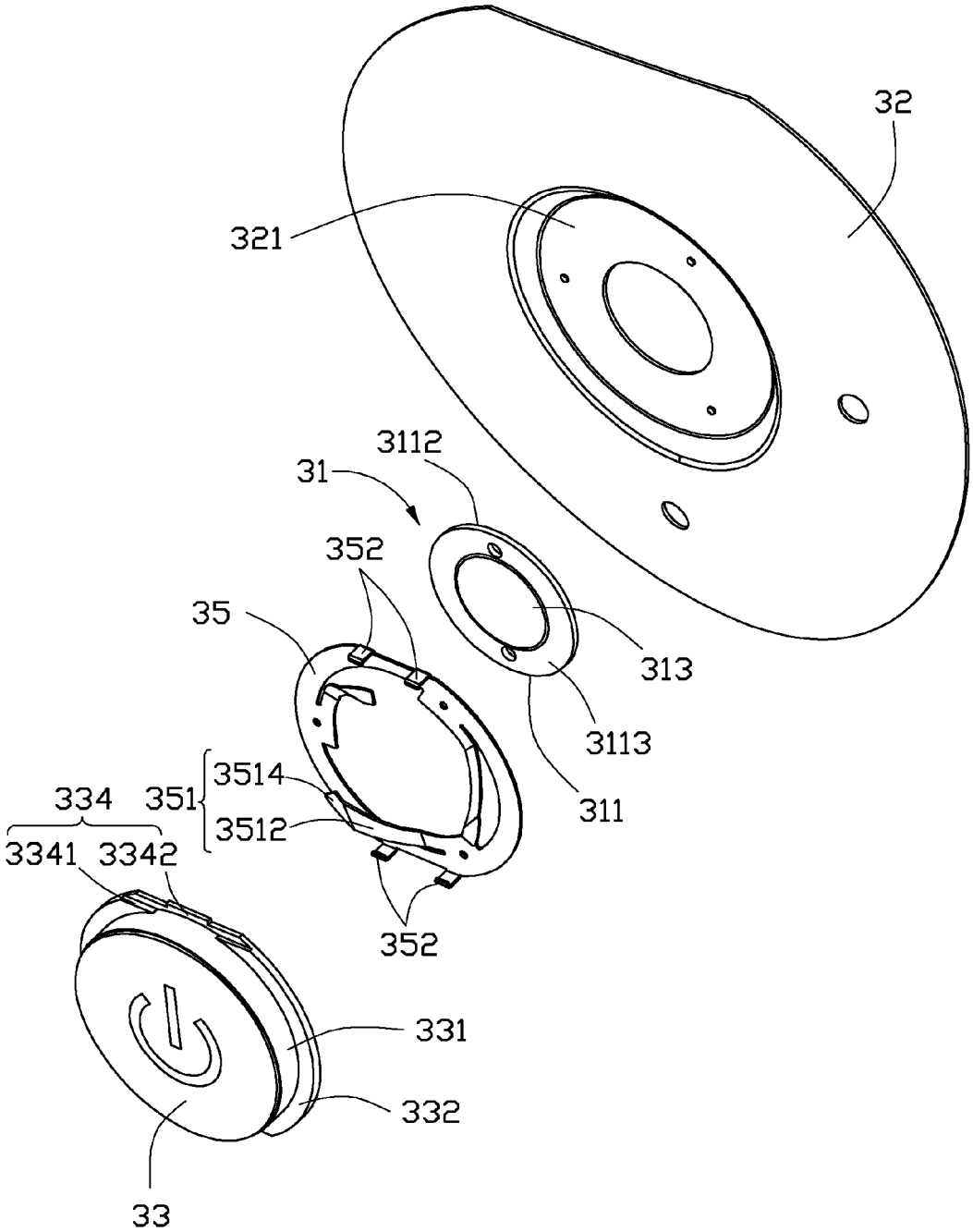
FIG. 3 is an exploded, isometric view of the power switch module.
Figure 4:
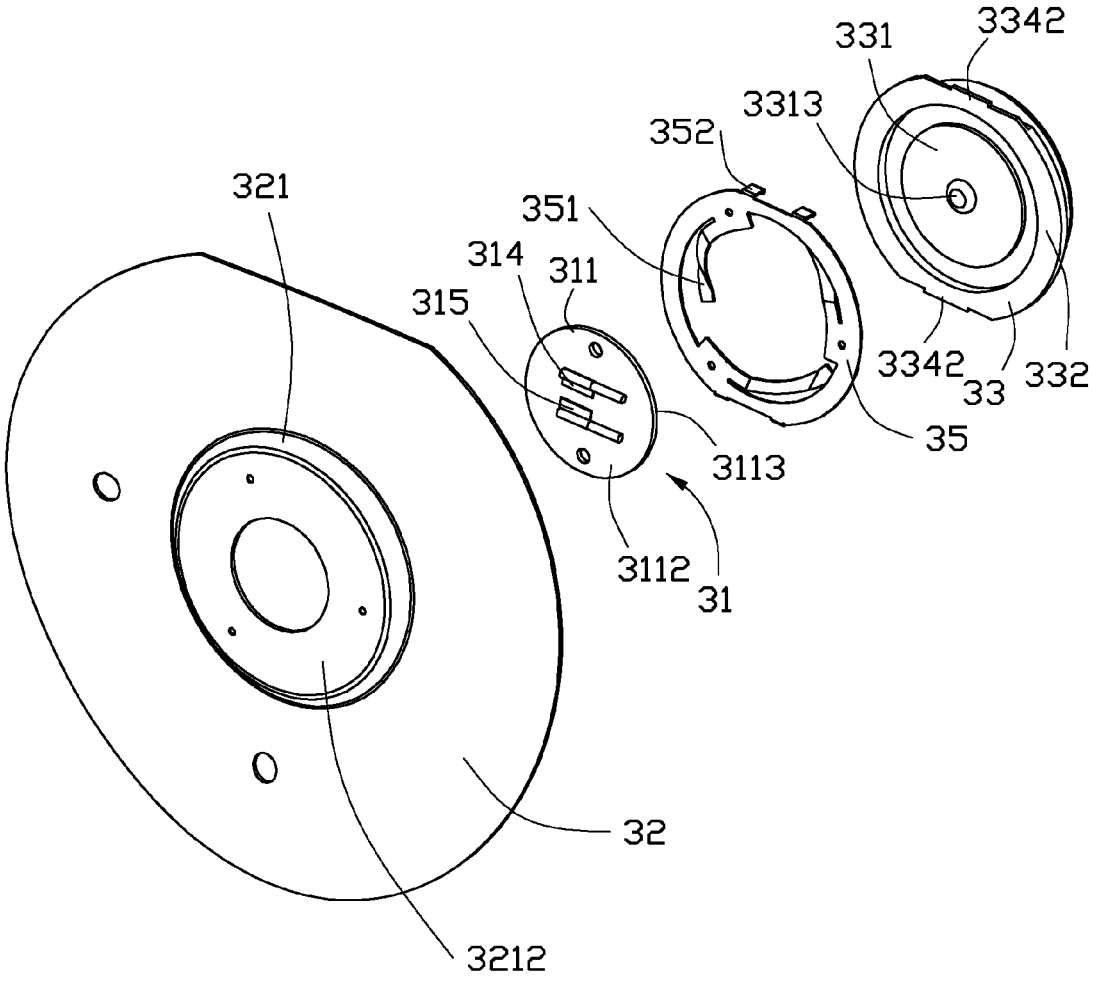
FIG. 4 is similar to FIG. 3, but viewed from another aspect.

Referring also to FIGS. 3 and 4, the power switch module 30 includes a printed circuit board 31, a support plate 32 engaging the printed circuit board 31, a control 33, and an elastic member 35 positioned between the printed circuit board 31 and the control 33 to generate an elastic force to resist the control 33.

The PCB 31 includes a mainboard 311 and a switch (not labeled). The mainboard 311 includes a first surface 3112 and a second surface 3113 opposite to the first surface 3112. The switch includes a dome 313 fixed on the second surface 3113, a first electric terminal 314, and a second electric terminal 315 adjacent to the first electric terminal 314. The first and second electric terminals 314, 315 are fixed on the first surface 3112 of the mainboard 311. The dome 313 is adjacent to the ends of the first and second electric terminals 314, 315, such that when the dome 313 is depressed, the first and second electric terminals 314, 315 electrically connect, thus turning the power supply on and off.

The support plate 32 is substantially an annular metal sheet. The support plate 32 defines a concavity 321 in the central position thereof to receive the elastic member 35 and the control 33. The concavity 321 has a bottom wall 3212 on which the main body 311 of the printed circuit board 31 is fixed. The support plate 32 may be fixed to the housing 20 by double sided adhesive, rivet joint, or any other means.

The control 33 includes a control cap 331 and a connecting portion 332 extending radially from the bottom edge of the control cap 331. A contact 3313 is formed on the control cap 331 corresponding to the dome 313 to activate the switch. Two latching portions 334 are formed on the outer circumferential edge portion of the connecting portion 332, and are opposite to each other. Each latching portion 334 includes a stepped surface 3341 and a restriction portion 3342 extending outward from the edge of the stepped surface 3341.

The elastic member 35 can be a substantially annular metal sheet. The elastic member 35 includes a plurality of resisting portions 351 to elastically resist the control 33 and a plurality of hook portions 352 to engage the latching portions 334 of the control 33. The resisting portions 351 are formed on the inner circumferential edge portion of the elastic member 35 extending along an axis of the elastic member 35. The hook portions 352 are formed on the outer circumferential edge portion of the elastic member 35 and extending substantially along an axis of the elastic member 35. In the illustrated embodiment, the elastic member 35 includes two pairs of hook portions 352, each engaging one corresponding latching portion 334, and the restriction portion 3342 extending between the pair of hook portions 352 to restrict the rotation of the elastic member 35, allowing accurate positioning thereof relative to the control 33.

The resisting portion 351 includes an elastic supporting arm 3512 and a resisting arm 3514 formed on the distal end of the elastic supporting arm 3512 and contacting the control 33, such that the resisting portion 351 generates stable elastic force to resist the control 33. In the illustrated embodiment, the elastic member 35 includes three resisting portions 35 at regular intervals along the circumference. The resisting portions 351 and the hook portions 352 may be formed by punching, simplifying manufacture.

During the assembly of the power switch module 30, the elastic member 35 can be fixed to the support plate 32 by rivet joint or conductive double sided adhesive and the elastic member 35 is received in the concave 321. The hook portions 352 engage with the stepped surface 3341 of the latching portion 334, and the restriction portion 351 is received between two hook portions 352, thus connecting the control 33 to the elastic member 35, with the resisting portions 351 resisting the control 33. Thus, assembly of the power switch module 30 is complete.

After the power switch module 30 is assembled, the control 33 is received in the assembly hole 21 of the housing 20, and the support plate 32 is fixed to the housing 20 by double sided adhesive or rivet joint, so that the power switch module 30 can be easily connected to the housing 20. It is unnecessary to provide dedicated hardware and manpower to assemble the power switch module 30 in the assembly line of the electronic device 100, because the power switch module 30 can be assembled elsewhere in advance.

In operation, as the control 33 is impelled toward the dome 313, the contact 3313 elastically deforms the dome 313 which electrically connects the first and second electric terminals 314, 315 to turn the power supply on and off, and the resisting portions 351 are compressed and accumulate elastic force. When the control 33 is released, the elastic force is released and the control 33 returns to the original position, whereby contact 3313 detaches from the dome 313 and turns the power supply off and on. As the elastic member 33 engages with the control 33, the elastic member 35 can be accurately positioned and generate stable elastic force. Furthermore, the elastic member 35 can alleviate any impact force on the dome 313, such that the printed circuit board 31 is protected.

In alternative embodiments, the hook portions 352 can be formed on the control 33, and the latching portion 334 can be formed on the elastic member 35 to engage with the hook portions 352.

It is believed that the present embodiments and their advantages will be understood from the foregoing description, and it will be apparent that various changes may be made thereto without departing from the spirit and scope of the embodiments or sacrificing all of its material advantages.

What is claimed is:

1. A power switch module for an electronic device comprising:

a printed circuit board comprising a switch;

a support plate engaging with the printed circuit board;

a control to activate the switch; and an elastic member fixed to the support plate and positioned between the printed circuit board and the control, the elastic member comprising a plurality of resisting portions thereon to elastically resist the control, wherein one of the elastic member and the control comprises a plurality of hook portions, and another one of the elastic member and the control comprises a plurality of latching portions engaging with the plurality of hook portions, and each of the plurality of resisting portions comprises an elastic supporting arm and a resisting arm formed on a distal end of the elastic supporting arm and contacting the control.

2. The power switch module of claim 1, wherein the plurality of hook portions is formed on the elastic member, and the plurality of latching portions is formed on the control, and each latching portion engages with a corresponding pair of hook portions.

3. The power switch module of claim 2, wherein each latching portion comprises a stepped surface engaging with the corresponding pair of hook portions and a restriction portion to restrict the rotation of the elastic member relative to the control.

4. The power switch module of claim 1, wherein the plurality of resisting portions is formed by punching and arranged in a circumferential orientation.

5. The power switch module of claim 1, wherein the elastic member is a substantially annular metal sheet, the plurality of resisting portions is formed on the inner circumferential edge portion of the elastic member, and the plurality of hook portions is formed on the outer circumferential edge portion of the elastic member.

6. The power switch module of claim 1, wherein the elastic member and the support plate are connected by conductive double sided adhesive or rivet joint.

7. An electronic device comprising:

a housing defining an assembly hole;

a power switch module comprising:

a printed circuit board comprising a switch;

a support plate engaging with the printed circuit board and fixed on the housing;

a control to activate the switch; and an elastic member fixed to the support plate and positioned between the printed circuit board and the control, the control being received in the assembly hole, the elastic member comprising a plurality of resisting portions thereon to elastically resist the control, wherein one of the elastic member and the control comprises a plurality of hook portions, and another one of the elastic member and the control comprises a plurality of latching portions engaging with the plurality of hook portions, and each of the plurality of resisting portions comprises an elastic supporting arm and a resisting arm formed on a distal end of the elastic supporting arm and contacting the control.

8. The electronic device of claim 7, wherein the plurality of hook portions is formed on the elastic member, and the plurality of latching portions is formed on the control, and each latching portion engages with a corresponding pair of hook portions.

9. The electronic device of claim 8, wherein each latching portion comprises a stepped surface engaging with the corresponding pair of hook portions and a restriction portion to restrict the rotation of the elastic member relative to the control.

10. The electronic device of claim 7, wherein the plurality of resisting portions is formed by punching and arranged along a circumferential axis.

11. The electronic device of claim 7, wherein the elastic member is a substantially annular metal sheet, the plurality of resisting portions is formed on the inner circumferential edge portion, and the plurality of hook portions is formed on the outer circumferential edge portion.

12. The electronic device of claim 7, wherein the elastic member and the support plate are connected by conductive double sided adhesive or rivet joint.

13. The electronic device of claim 7, wherein the support plate is fixed on the housing by double sided adhesive.

* * * * *